United States Patent [19]

Agee et al.

[11] 4,265,218

[45] May 5, 1981

[54] FAILSAFE PROTECTION DAMPER FOR A FIREPLACE FURNACE

[75] Inventors: John H. Agee, Fremont, Nebr.; Marshall D. Albert, Woodbine, Iowa

[73] Assignee: American Road Equipment Co., Omaha, Nebr.

[21] Appl. No.: 94,220

[22] Filed: Nov. 14, 1979

[51] Int. Cl.[3] ..... F23L 3/00

[52] U.S. Cl. ..... 126/288; 126/122; 237/51

[58] Field of Search ..... 126/121, 122, 125, 131, 126/288; 237/51, 55; 165/40, 95

[56] References Cited

U.S. PATENT DOCUMENTS

| | | | |
|---|---|---|---|
| 2,231,258 | 2/1941 | Elmore | 126/122 |
| 2,480,596 | 8/1949 | Mueller | 237/55 |
| 4,108,238 | 8/1978 | Vary | 165/40 |
| 4,138,062 | 2/1979 | Graden | 237/55 |
| 4,179,065 | 12/1979 | Zung | 237/51 |

*Primary Examiner*—James C. Yeung

*Attorney, Agent, or Firm*—Zarley, McKee, Thomte, Voorhees & Sease

[57] ABSTRACT

A fireplace furnace includes an outer housing disposed about a firebox to define a heat chamber therebetween. A blower is associated with an air intake opening through a lower portion of the heat chamber for forcing air therethrough. Air exits from the heat chamber through first and second heat outlets. The second heat outlet includes a generally vertical duct with a damper pivotally supported therein for movement between a generally horizontal closed position and an upright open position. The damper is biased to its closed position and is opened against the urging of the biasing mechanism by forced air flow through the heat chamber by the blower with the result that the damper is automatically closed by the biasing mechanism when power to the blower is cut off.

13 Claims, 6 Drawing Figures

FAILSAFE PROTECTION DAMPER FOR A FIREPLACE FURNACE

BACKGROUND OF THE INVENTION

The present invention is directed generally to a combination fireplace furnace unit and more particularly to a failsafe damper adapted to close at least one of the heat outlets thereof whenever the furnace blower is inoperative.

Auxiliary fireplace furnaces have become increasingly popular in recent years due to the escalating cost of operating conventional oil, gas and electric furnaces. By connecting the heat outlet of a fireplace furnace to the air distribution duct work of a building, heat from the fireplace may be distributed throughout the house to supplement or replace heating by the conventional furnace.

Excessive temperature buildup within the heat chamber is normally prevented by the continuous flow of intake air through the heat chamber by the blowers. In the event of a power failure or breakdown of the blower, however, the temperature within the heat chamber may rise to approximately 900° F. If this 900° air is allowed to rise by convection into the building duct work, a fire hazard may be created due to the proximity of combustible construction materials adjacent the duct work. Another heat outlet from the heat chamber may open through a masonry wall or the like into the room in which the fireplace is situated so that hot air exiting therethrough is substantially dissipated and cooled before contacting any combustible surfaces. There is a need therefore for a failsafe means of closing the fireplace furnace outlets which communicate with the building duct work, whenever the blowers cease to operate.

The present invention proposes to provide a damper within the heat outlet to the building duct work, which damper is adapted to close whenever the blowers are inoperative. But horizontally disposed dampers which are commercially available have been found to be unsuitable. The check valve-type dampers which include a seated valve element experience critical lubrication problems at very high temperatures. Likewise, power actuated dampers and thermostatically controlled dampers would generally burn out well before the heat chamber temperature reaches its maximum level.

A further problem related to the connection of an auxiliary fireplace furnace to the air distribution duct work of a building is that, when the fireplace furnace is inoperative, backflow of the forced air from the main furnace or air conditioning unit through the fireplace furnace must be prevented.

Accordingly, it is a primary object of the present invention to provide a failsafe protection damper for a fireplace furnace.

Another object is to provide a damper in the heat outlet of a fireplace furnace, which damper is adapted to close whenever the fireplace blowers are inoperative.

Another object is to provide a fireplace furnace damper adapted to prevent the backflow of forced air from a conventional furnace unit into the fireplace furnace.

SUMMARY OF THE INVENTION

The fireplace furnace of the present invention includes a firebox situated within an outer housing so as to define a heat chamber therebetween. The outer housing has an air intake opening through a lower portion of one wall and first and second heat outlets through an upper portion thereof. A first heat outlet communicates with the room in which the fireplace furnace is situated and the second heat outlet communicates with a vertical duct means for delivery of a portion of the heat to a remote location. A power actuated blower forces air through the intake opening, into the heat chamber and outwardly through the heat outlet. A damper is supported within the vertical duct means for pivotal movement between a generally horizontal closed position and an upright open position. A bias means urges the damper to its generally horizontal closed position. Forced air from the blower however is effective to open the damper against the urging of the bias means to provide for heat flow upwardly through the vertical duct means. In the event that the blower ceases operation for any reason, the bias means automatically closes the damper to prevent the passage of excessively hot air through the second heat outlet.

When the second heat outlet is connected to the air distribution duct work of a building, the damper of the invention thus provides failsafe protection against a fire which could otherwise result if the extremely high temperature air from the heat chamber were allowed to rise simply by convection into the building duct work. Because the duct is biased to its closed position, it is likewise advantageously operative to prevent the backflow of forced air from the conventional furnace or air conditioning unit outwardly through the fireplace furnace. The failsafe fireplace furnace duct of the present invention is simple in construction yet operative under extreme temperature conditions to provide failsafe protection for the home or commercial building in which the fireplace furnace is installed.

DESCRIPTION OF THE PREFERRED EMBODIMENT

Figure 1:
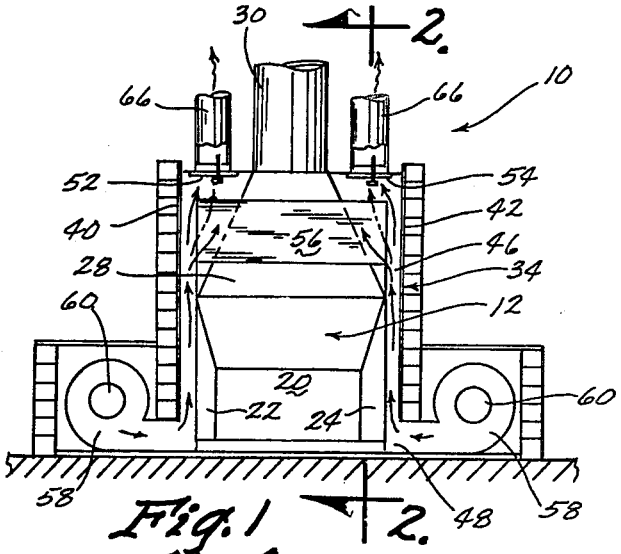
FIG. 1 is a partially sectional front elevational view of a fireplace furnace including a pair of dampers.
Figure 2:
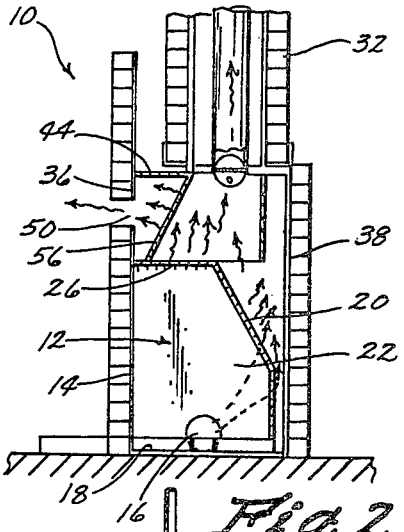
FIG. 2 is a side sectional view of the fireplace furnace of FIG. 1.

A fireplace furnace, indicated generally at 10 in FIGS. 1 and 2, includes a firebox 12 which is open at the front as at 14 for the insertion of firewood 16 or other combustible material. The firebox includes a bottom wall 18, a forwardly inclined rear wall 20, opposite sidewalls 22, 24 and a top wall 26. An opening through top wall 26 communicates with an upwardly tapering housing 28 which leads to a vertical flue 30 which is housed within a chimney 32 of masonry, tile or other suitable material.

The firebox 12 is surrounded on three sides by an outer housing 34 which includes a front wall 36, rear wall 38, opposite sidewalls 40 and 42 and a generally horizontal top wall 44. Outer housing 34 is spaced from the firebox 12 so as to define a heat chamber 46 between them.

To provide air circulation through the heat chamber, each sidewall 40 and 42 is provided with an air intake opening 48 adjacent its lower edge and front wall 36 is provided with a first heat outlet 50 for delivery of warm air to the room in which the fireplace furnace is situated. In addition, top wall 44 includes second and third heat outlets 52 and 54 through which heat may be directed to remote locations. A transversely extended baffle 56 above the firebox 12 terminates short of the sidewalls 40 and 42 to apportion airflow between the first, second and third heat outlets as indicated by arrows 58 in FIGS. 1 and 2.

An intake air blower 58 is associated with each air intake opening 48 to provide for forced airflow through the heat chamber 46. The blowers are preferably operated by electric motors 60 which may be thermostatically controlled to operate whenever the temperature within the heat chamber reaches a predetermined level.

Each of the second and third heat outlets 52 and 54 includes a vertical duct means including an annular riser flange 62 on a mounting plate 64 which is adapted for securement to the underside of top wall 44. Cylindrical heat ducts 66 are fit over the annular flanges 62 for conveying heat away from the heat outlets.

Figure 3:
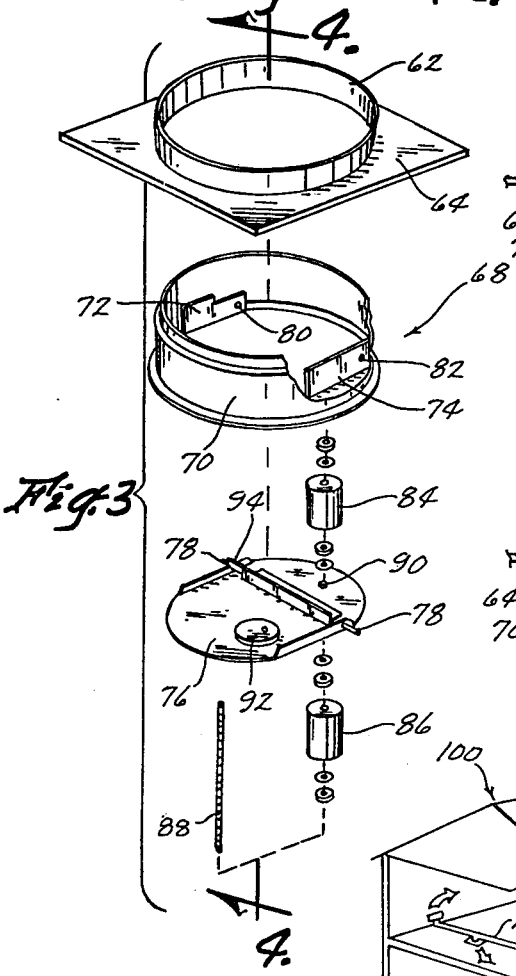
FIG. 3 is an enlarged exploded perspective view of the horizontal damper.
Figure 4:
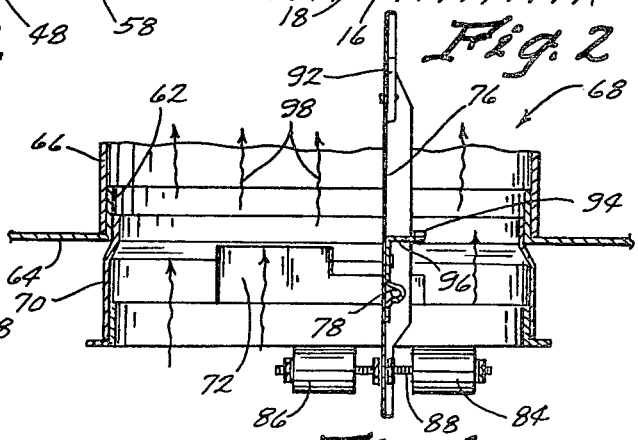
FIG. 4 is a further enlarged transverse sectional view showing the damper in an open position.
Figure 5:
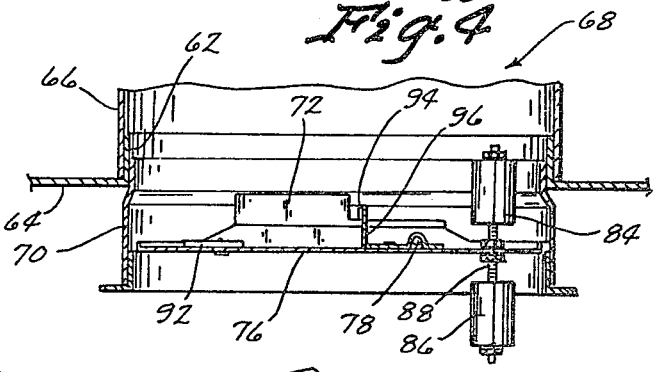
FIG. 5 is a transverse sectional view similar to FIG. 4, showing the damper in a closed position.

The damper 68 of the present invention is shown in FIGS. 3–5 as including an outer annular housing 70 having a reduced diameter upper edge for insertion in press-fit relation within the annular flange 62 of mounting plate 64. The damper housing 70 has a pair of oppositely disposed brackets 72 and 74 between which the damper plate 76 is pivotally supported on a generally horizontal support rod 78. Opposite ends of rod 78 are received in respective holes 80 and 82 of brackets 72 and 74. Rod 78 is offset from the center of the damper plate 76 in the usual manner. A pair of weights 84 and 86 are adjustably carried on the damper plate 76 by means of a threaded rod 88 which is inserted through a bore 90 on the small side of the damper plate. A counterweight 92 is secured to the opposite side of the damper plate.

Damper plate 76 is pivotally movable between a generally upright open position shown in FIG. 4 and a generally horizontal closed position shown in FIG. 5. In the closed position, bracket 72 is engaged by a transverse extension 94 of a channel member 96 which is secured to the top side of the damper plate 76. Thus bracket 72 and extension 94 coact as a stop means for limiting pivotal movement in one direction to the closed position as shown.

The weights 84, 86 and counterweight 92 are adjusted to normally bias the damper plate 76 to the closed position of FIG. 5. The balance is adjusted so that hot air rising within the heat chamber 46 by convection currents alone will be insufficient to move the damper plate from its closed position. Forced airflow due to the operation of the blowers 58, however, causes the damper plate 76 to be readily pivoted to the open position for airflow upwardly through ducts 66 as indicated by arrows 98.

Figure 6:
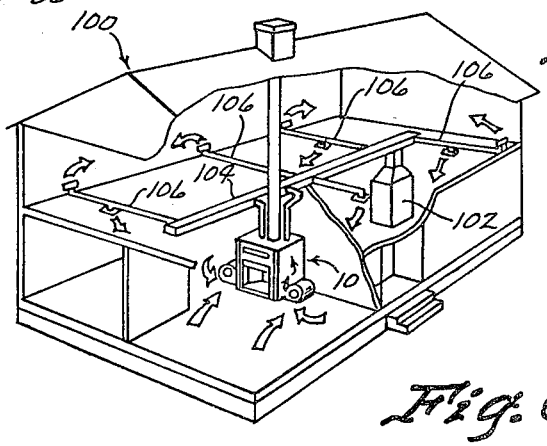
FIG. 6 is a diagrammatic perspective view of the fireplace furnace connected to a building heat duct system.

In FIG. 6, the auxiliary fireplace furnace 10 of the present invention is shown installed in a building 100 which includes a conventional furnace unit 102 connected to a plurality of forced air distribution ducts 104 and 106. In this embodiment, the hot air ducts 66 of the auxiliary fireplace furnace 10 are also connected to the duct 104 for distributing hot air throughout the building. When the conventional furnace 102 is in operation, forced air through duct 104 and heat ducts 66 operates to close the dampers 68 thereby preventing backflow of air through the auxiliary fireplace furnace 10. This is important in warm weather when cool air may be distributed through the duct work 104 and 106 by a central air conditioning unit associated with the main furnace 102.

In operation, a building owner may conserve heating fuel by setting the control thermostat for the main furnace 102 at a lower temperature than desired and then starting a fire within the firebox 12 of the auxiliary fireplace furnace to supply the desired heat. As the fire burns, exhaust gases are directed upwardly through the flue and the temperature within the heat chamber 46 rapidly rises. Note that the damper plates 76 are biased by the weights 84 to a closed position at this initial stage. As the temperature within the heat chamber 46 reaches a predetermined level, the intake air blowers 58 are actuated to create a forced air movement upwardly through the heat chamber and outwardly through the first, second and third heat outlets 50, 52 and 54. The forced air movement from the blowers 58 pivots the damper plates 76 to their upright open positions and maintains the damper plates in the open position until the blowers are once again shut off.

In the event of a power failure or breakdown of the blowers 58 for any other reason, forced airflow through the heat chamber 46 ceases and the damper plates 76 are biased back to their horizontally disposed closed positions. Without forced air-flow from the blowers, the temperature within the heat chamber may rise to approximately 900° F. Such dangerously hot air is prevented by dampers 68 from rising into the heat duct 66 by convection currents alone. Accordingly, the fire hazard due to combustible materials being adjacent the ducts 104 and 106 is eliminated.

Thus there has been shown and described a failsafe damper for a fireplace furnace which accomplishes at least all of the stated objects.

We claim:

1. A fireplace furnace comprising, a firebox adapted for burning combustible fuels therein, flue means in communication with said firebox for exhausting combustion gases therefrom, an outer housing partially surrounding said firebox and spaced therefrom to define a heat chamber therebetween, said outer housing including an air intake opening through a lower portion thereof for supplying intake air to said heat chamber and first and second heat outlets through an upper portion thereof, said second heat outlet including a generally vertical duct means having an entrance end in communication with said heat chamber, a power actuated blower associated with said intake opening for forcing air into said intake opening, through said heat chamber and outwardly through said first and second heat outlets, a damper supported within said vertical duct means for pivotal movement between a generally horizontal closed position and an upright open position, said damper being positioned at the entrance end of the vertical duct means adjacent said upper portion of said outer housing, bias means urging said damper to the generally horizontal closed position therefor, and said damper being opened against the urging of said bias means in response to the flow of forced air through said heat chamber by said blower whereby said damper is closed by said bias means when power to the blower is cut off.

2. The fireplace furnace of claim 1 wherein said outer housing includes a top wall and front, back and opposite sidewalls, said second heat outlet opening through said top wall.

3. The fireplace furnace of claim 2 wherein said first heat outlet opens through said front wall.

4. The fireplace furnace of claim 1 wherein said power actuated blower comprises an electric motor and blower means driven by said motor.

5. The fireplace furnace of claim 1 wherein said bias means comprises a weight supported on said damper relative to the pivot axis therefor so as to urge said damper to the generally horizontal closed position therefor.

6. The fireplace furnace of claim 1 further comprising a second air intake opening, a second power actuated blower associated with said second intake opening, and a third heat outlet through said top wall and including a second damper pivotally supported therein.

7. The fireplace furnace of claim 1 wherein said first heat outlet remains at least partially open at all times.

8. The fireplace furnace of claim 1 wherein said vertical duct means includes an annular flange extended outwardly from an opening through said top wall, said flange adapted for a telescopic connection to one end of an elongated tubular duct.

9. In combination with a forced air heating system including a main furnace and a plurality of heat ducts in communication therewith for distributing hot air to remote locations, a fireplace furnace including, a firebox adapted for burning combustible fuels therein, flue means in communication with said firebox for exhausting combustion gases therefrom, an outer housing partially surrounding said firebox and spaced therefrom to define a heat chamber therebetween, said outer housing including an air intake opening through a lower portion thereof for supplying intake air to said heat chamber and first and second heat outlets through an upper portion thereof, said second heat outlet including a generally vertical duct means having an entrance end in communication with said heat chamber and an opposite end in communication with one of said heat ducts for supplying hot air thereto, a power actuated blower associated with said intake opening for forcing air into said intake opening, through said heat chamber and outwardly through said first and second heat outlets, a damper supported within said vertical duct means for pivotal movement between a generally horizontal closed position and an upright open position, said damper being positioned at the entrance end of the vertical duct means adjacent said upper portion of said outer housing, bias means urging said damper to the generally horizontal closed position therefor, and said damper being opened against the urging of said bias means in response to the flow of forced air through said heat chamber by said blower whereby said damper is normally closed when the blower is inoperative thereby to prevent the backflow of air from said main furnace into said fireplace furnace.

10. The combination of claim 9 wherein said fireplace furnace is disposed along a masonry wall including a first opening in communication with said firebox for supplying fuel thereto and a second opening in communication with said first heat outlet.

11. A fireplace furnace comprising, a firebox adapted for burning combustible fuels therein, flue means in communication with said firebox for exhausting combustion gases therefrom, a chimney surrounding said flue means, an outer housing partially surrounding said firebox and spaced therefrom to define a heat chamber therebetween, said outer housing including an air intake opening for supplying intake air to said heat chamber and first and second heat outlets through an upper portion thereof, said second heat outlet including a generally vertical duct means having at least a lower portion disposed within said chimney, a power actuated blower associated with said outer housing for forcing air into said intake opening, through said heat chamber and outwardly through said first and second heat outlets, a damper supported within said vertical duct means at a position within said chimney for pivotal movement between a generally horizontal closed position and an upright open position, bias means urging said damper to the generally horizontal closed position therefor, and said damper being opened against the urging of said bias means in response to the flow of forced air through said heat chamber by said blower whereby said damper is closed by said bias means when power to the blower is cut off.

12. In combination with a forced air heating system including a main furnace and a plurality of heat ducts in communication therewith for distributing hot air to remote locations, a fireplace furnace including, a firebox adapted for burning combustible fuels therein, flue means in communication with said firebox for exhausting combustion gases therefrom, a chimney surrounding said flue means, an outer housing partially surrounding said firebox and spaced therefrom to define a heat chamber therebetween, said outer housing including an air intake opening through a lower portion thereof for supplying intake air to said heat chamber and first and second heat outlets through an upper portion thereof, said second heat outlet including a generally vertical duct means in communication with one of said heat ducts for supplying hot air thereto, said vertical duct means including at least a lower portion positioned within said chimney, a power actuated blower associated with said intake opening for forcing air into said intake opening, through said heat chamber and outwardly through said first and second heat outlets, a damper supported within said vertical duct means at a position within said chimney for pivotal movement between a generally horizontal closed position and an upright open position, bias means urging said damper to the generally horizontal closed position therefor, and said damper being opened against the urging of said bias means in response to the flow of forced air through said heat chamber by said blower whereby said damper is normally closed when the blower is inoperative thereby to prevent the backflow of air from said main furnace into said fireplace furnace.

13. A fireplace furnace comprising, a firebox adapted for burning combustible fuel therein, flue means in communication with said firebox for exhausting combustion gases therefrom, a chimney surrounding said flue means, an outer housing partially surrounding said firebox and spaced therefrom to define a heat chamber therebetween, said outer housing including an air intake opening for supplying intake air to said heat chamber and first and second heat outlets through an upper portion thereof, said second heat outlet including a generally vertical duct means having at least a lower portion disposed within said chimney, a power actuated blower associated with said outer housing for forcing air into said intake opening, through said heat chamber and outwardly through said first and second heat outlets, a damper supported within said vertical duct means at a position within said chimney for pivotal movement between closed and open positions, bias means urging said damper to the closed position therefor, and said damper being opened against the urging of said bias means in response to the flow of forced air through said heat chamber by said blower whereby said damper is closed by said bias means when power to the blower is cut off.

* * * * *